US009636884B2

(12) United States Patent
Stroud

(10) Patent No.: US 9,636,884 B2
(45) Date of Patent: May 2, 2017

(54) BOX CONFIGURING TOOL AND DISPENSER

(71) Applicant: Otto M Stroud, Virginia Beach, VA (US)

(72) Inventor: Otto M Stroud, Virginia Beach, VA (US)

( * ) Notice: Subject to any disclaimer, the term of this patent is extended or adjusted under 35 U.S.C. 154(b) by 0 days.

(21) Appl. No.: 15/134,001

(22) Filed: Apr. 20, 2016

(65) Prior Publication Data

US 2016/0318276 A1 Nov. 3, 2016

Related U.S. Application Data

(60) Provisional application No. 62/154,835, filed on Apr. 30, 2015.

(51) Int. Cl.

| | |
|---|---|
| ***B31B 1/78*** | (2006.01) |
| ***B31B 47/04*** | (2006.01) |
| ***B65B 67/02*** | (2006.01) |

(52) U.S. Cl.

CPC ..... *B31B 47/04* (2013.01); *B65B 67/02* (2013.01); *B31B 2201/281* (2013.01); *B31B 2247/00* (2013.01)

(58) Field of Classification Search

CPC ..... B31B 47/04; B31B 2247/00; B65B 67/02

USPC ..... 493/309, 440, 447, 456, 70

See application file for complete search history.

(56) References Cited

U.S. PATENT DOCUMENTS

| | | | | | |
|---|---|---|---|---|---|
| 2,947,229 | A * | 8/1960 | Caresio | B31B 1/76 | 493/310 |
| 3,477,349 | A * | 11/1969 | Berney | 227/108 | |
| 3,748,972 | A * | 7/1973 | Barton | B31B 1/06 | 493/124 |
| 3,796,141 | A * | 3/1974 | Mueller | 493/310 | |
| 3,800,681 | A * | 4/1974 | Corderoy | B31B 1/46 | 493/151 |
| 3,896,711 | A * | 7/1975 | Vuilleumier | B31B 1/80 | 493/314 |
| 3,915,077 | A * | 10/1975 | LaFleur | B31B 37/00 | 156/510 |
| 4,160,406 | A * | 7/1979 | Nowacki | B31B 1/06 | 493/125 |
| RE30,921 | E * | 5/1982 | McDowell | B31B 1/06 | 271/132 |
| 4,437,851 | A * | 3/1984 | Salenbo | B31B 1/80 | 493/123 |
| 4,512,756 | A * | 4/1985 | Fields | B31B 1/76 | 493/312 |
| 4,578,054 | A * | 3/1986 | Herrin | B31B 1/06 | 493/126 |
| 4,678,456 | A * | 7/1987 | Nigrelli, Sr. | B31B 1/06 | 493/309 |

(Continued)

*Primary Examiner* — Sameh Tawfik

(74) *Attorney, Agent, or Firm* — Peter J. Van Bergen

(57) ABSTRACT

A box configuring tool includes a base having a planar surface, a first stop positioned at a first end of the base, and a second stop positioned at a second end of the base opposing the first end of the base. The tool also includes a pair of spaced-apart walls coupled to the base to define an open-ended chute along the base's planar surface. The open-ended chute is disposed between the first stop and the second stop. The open-ended chute has a tapered-width portion contiguous with a constant-width portion.

13 Claims, 5 Drawing Sheets

(56) References Cited

U.S. PATENT DOCUMENTS

| | | | | | |
|---|---|---|---|---|---|
| 5,059,165 | A * | 10/1991 | Wallin | B31B 1/50 | 493/137 |
| 5,178,600 | A * | 1/1993 | Harder | B31B 47/02 | 493/162 |
| 5,378,222 | A * | 1/1995 | Weber | B65H 45/12 | 493/405 |
| 5,380,265 | A * | 1/1995 | Giovinazzo | B65H 45/12 | 493/405 |
| 5,632,713 | A * | 5/1997 | Canning | B31B 1/52 | 493/137 |
| 5,733,237 | A * | 3/1998 | Marschke | B65H 45/12 | 493/405 |
| 6,186,931 | B1 * | 2/2001 | Calvert | B31B 1/50 | 493/136 |
| 7,753,833 | B2 * | 7/2010 | Crick | B31F 1/08 | 493/160 |
| 2011/0077138 | A1 * | 3/2011 | Pagani | B31B 3/00 | 493/162 |

* cited by examiner

BOX CONFIGURING TOOL AND DISPENSER

Pursuant to 35 U.S.C. §119, the benefit of priority from provisional application 62/154,835, with a filing date of Apr. 30, 2015, is claimed for this non-provisional application.

FIELD OF THE INVENTION

The invention relates generally to tools used to configure boxes, and more particularly to a tool and dispenser for configuring a book-folded blank into an open-top box configuration ready to receive contents such as a cooked pizza.

BACKGROUND OF THE INVENTION

The "to go" food industry has grown enormously in recent years as cooking at home has become more the exception than the rule. One of the biggest "to go" foods is pizza. Whether a pizza shop is part of a chain/franchise or a "mom and pop" restaurant, the boxes used to hold pizzas are generally delivered as flat blanks that must be folded into a box prior to use. Typically, a pizza shop owner/manager treats the task of assembling and stacking empty boxes as an offline process. This leads to several problems ranging from cost to sanitation. For example, there is labor cost associated with the box assembly operation that ultimately adds to the cost per pizza sold. In addition, the empty assembled boxes take up a substantial amount of space that typically is at a premium in the kitchen area of most pizza shops. Sanitation issues arise when delivery drivers, cashiers, etc., are called upon to fold boxes without proper food handling training. Still further, pre-folded boxes left overnight present hiding and nesting places for insects and rodents.

SUMMARY OF THE INVENTION

Accordingly, it is an object of the present invention to provide box configuring tool.

Another object of the present invention is to provide a pizza box configuring tool that reduces the time it takes to fold/assemble a pizza box blank.

Still another object of the present invention is to provide a pizza box dispenser and configuring tool that can be used to configure a pizza box blank to receive a pizza.

Other objects and advantages of the present invention will become more obvious hereinafter in the specification and drawings.

In accordance with the present invention, a box configuring tool includes a base having a planar surface, a first stop positioned at a first end of the base and extending from its planar surface, and a second stop positioned at a second end of the base opposing the first end of the base. The second stop extends away from the planar surface. The tool also includes a pair of spaced-apart walls coupled to the base. The walls extend away from the base's planar surface to define an open-ended chute along the planar surface. The open-ended chute is disposed between the first stop and the second stop. The open-ended chute has a tapered-width portion contiguous with a constant-width portion.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
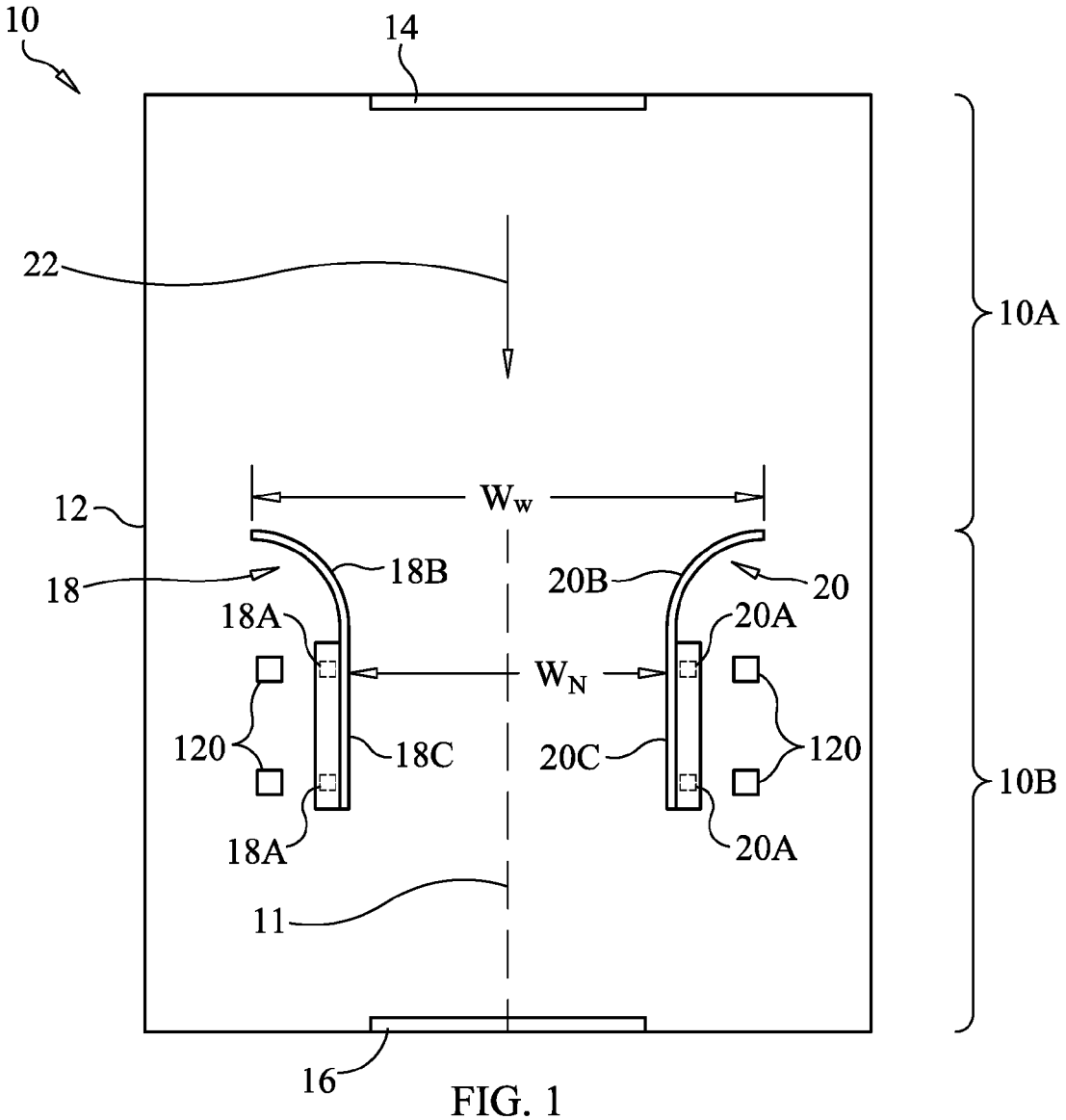
FIG. 1 is a plan view of a box configuring tool in accordance with an embodiment of the present invention.

Referring now to the drawings and more particularly to FIG. 1, a box configuring tool in accordance with an embodiment of the present invention is shown and is referenced generally by numeral 10. In general and as will be explained further below, tool 10 can be used to configure a pizza box blank into an open-box configuration thereof simply by pulling a book-folded box blank through tool 10 using one hand. In this way, a pizza chef can use one hand to configure a pizza box into an open and "ready to receive a pizza" configuration, and then place a freshly-cooked pizza into the box using his other hand. The box is then closed with the pizza in place. The box does not need to be pre-made, stored, and then opened prior to use thereby reducing labor and storage costs, as well as sanitation concerns.

Configuring tool 10 is generally made from rigid materials that are readily cleaned and disinfected given that it will be used in a food preparation environment. For example, stainless steel (e.g., type 304) can be used for the various elements of tool 10. However, it is to be understood that other materials could be used for tool 10 without departing from the scope of the present invention.

Configuring tool 10 includes a base 12, a back stop 14, a front stop 16, and chute sides or walls 18 and 20. Base 12 is a generally contiguous planar element/surface defining a staging region 10A and a chute region 10B of tool 10. Base 12 can be a standalone element resting on or coupled to an existing platform, or be the top of an existing work surface without departing from the scope of the present invention. Back stop 14 is an element coupled to or integrated with base 12 that extends upward from the planar surface defined by base 12. Back stop 14 defines the end of staging region 10A to provide a user with a visual and tactile index of where a folded box blank is to be placed prior to the box configuring operation. Front stop 16 is an element coupled to or integrated with base 12 that extends upward from the planar surface defined by base 12. Front stop 16 defines the end of chute region 10B to provide a user with a visual and tactile index of where a tool-configured open box is optimally configured and positioned to receive a pizza, i.e., where the configuring operation is complete.

Figure 2:
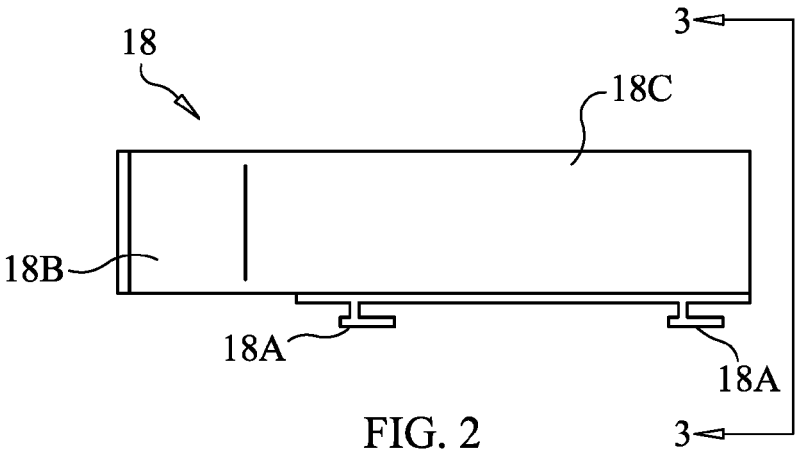
FIG. 2 is an isolated side view of one of tool's chute walls.
Figure 3:
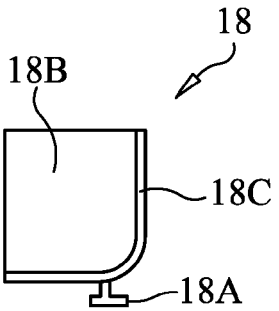
FIG. 3 is an end view of the chute wall taken along line 3-3 in FIG. 2.

Referring additionally to FIGS. 2 and 3, chute walls 18 and 20 define the vertical sides of an open-ended trough or chute that will engage the sides of a pizza box blank as the box blank is pulled along a path on base 12 between back stop 14 and front stop 16. The base of the chute is defined by the portion of base 12 between chute walls 18 and 20. Accordingly, the chute defines a portion of the path along base 12 between back stop 14 and front stop 16. Chute walls 18 and 20 are mirror images of one another relative to a center of chute region 10B indicated by dashed line 11. Accordingly, the following description of chute wall 18 also applies to chute wall 20. Chute walls 18 and 20 can be configured for adjustable positions on base 12 or fixed positions on base 12 without departing from the scope of the present invention. In the illustrated embodiment, chute wall 18 has feet 18A (e.g., two are shown) that engage corresponding holes 120 in base 12 to position chute wall 18. Note that only the unused ones of holes 120 are visible in FIG. 1 as the ones being used by the illustrated chute walls 18 and 20 are hidden from view. Using selected ones of holes 120, chute walls 18 and 20 can be positioned to work with different size of pizza boxes. It is to be understood that the present invention is not limited to feet/hole adjustability as shown. For example, chute walls 18/20 could be slidably mounted to base 12 for side-to-side adjustment thereon. Other possibilities include magnetic coupling of chute walls 18/20 to base 12.

Chute walls 18/20 include flared portions 18B/20B (e.g., arcuately shaped in this embodiment) that flare out/away from center 11 and parallel linear portions 18C/20C. Accordingly, flared portions 18B/20B define an open-ended tapering-width portion of the chute that is contiguous with an open-ended constant-width portion of the chute defined by parallel linear portions 18C/20C. The entire open-ended chute defined by chute walls 18/20 is aligned with and spaced-apart from back stop 14 and front stop 16. When positioned on base 12, the spacing between the outboard ends of flared portions 18B/20B (i.e., one open end of the chute) defines the widest width "$W_W$" of the chute that is immediately adjacent to staging region 10A. Each of flared portions 18B/20B can define a non-linear, gently curved arc (as shown) that is contiguous with the respective parallel linear portion 18C/20C. Spacing between portions 18C and 20C defines the narrowest width "$W_N$" of the chute. In general, the widest width $W_W$ of the chute is slightly greater than the width of a book-folded blank of a pizza box being pulled from staging region 10A to chute region 10B as indicated by arrow 22. The narrowest width $W_N$ of the chute is slightly greater than the width of a pizza box configured into its open-box-configuration thereof. The actual dimensions of $W_W$ and $W_N$ depend on the size of the pizza box and the desired amount of side-to-side movement of a pizza box moving through chute region 10B.

Figure 4:
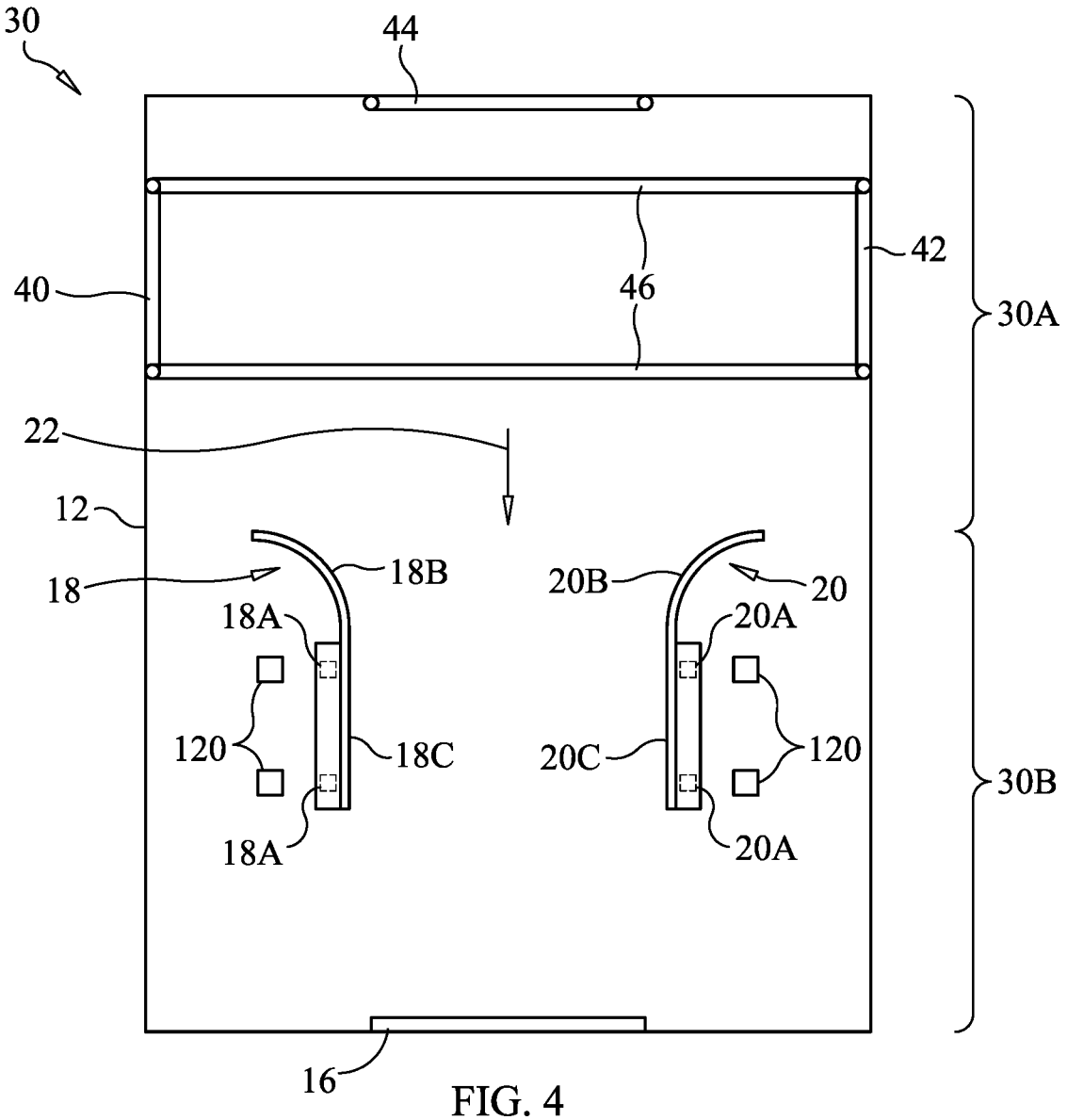
FIG. 4 is a plan view of a box dispenser and configuring tool in accordance with another embodiment of the present invention.
Figure 5:
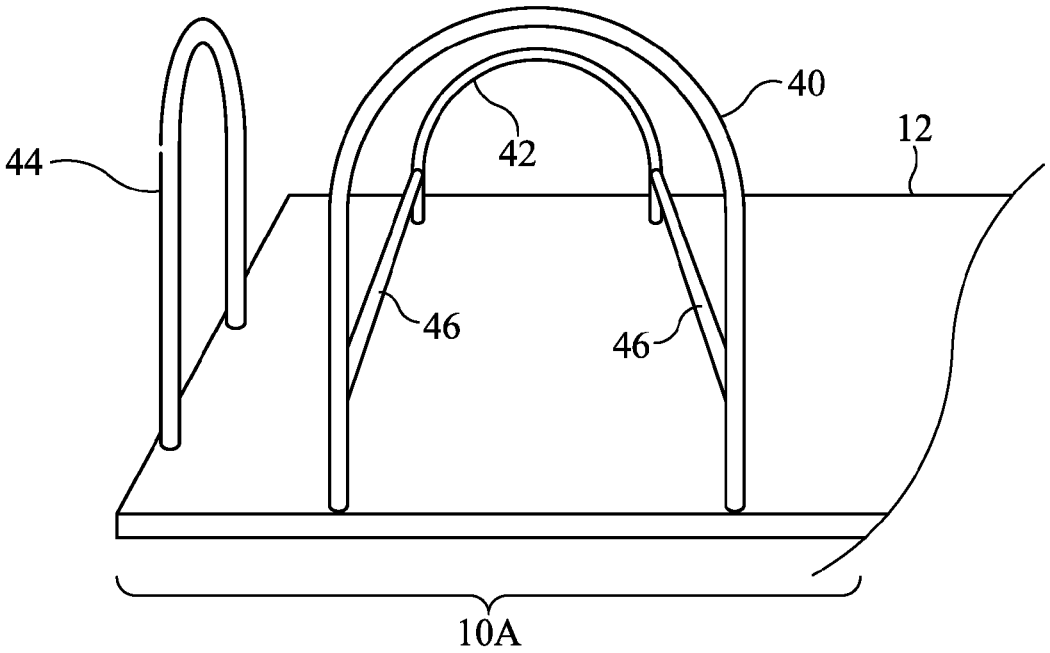
FIG. 5 is a side perspective view of a portion of the configuring tool in FIG. 4 illustrating the box blank dispenser portion thereof.

The present invention can also be readily adapted to incorporate a dispensing function at/above staging region 10A. For example and as illustrated in FIGS. 4 and 5, a box configuring tool and dispenser 30 includes a staging region 30A and a chute region 30B analogous to above-described regions 10A and 10 ft respectively. In addition, tool/dispenser 30 includes a book-folded-blank dispenser defined by side supports 40/42, a back support 44, and bottom rails 46 coupled to and spanning between side supports 40/42 to define a platform for a stack of folded box blanks that is spaced apart from and above base 12. Each of side supports 40/42 and back of support 44 can be attached to or integrated with base 12 without departing from the scope of the present invention. It is further to be understood that the inverted U-shape of the supports is exemplary only and that other shapes/configurations could be used. Note that back support 44 could also provide the functionality of back stop 14 described above.

In use, book-folded blanks of pizza boxes (not shown) are stacked on bottom rails 46 between supports 40/42/44. A user, positioned near the tool's front stop, takes a folded blank from the stack and places it on base 12 in staging region 30A, i.e., underneath bottom rails 46 with the fold of the blank adjacent to back support 44. The folded blank is then pulled in the direction of arrow 22 into and through chute region 30B in order to configure the blank into its open-box configuration thereof once the box reaches the tool's front stop as will be explained later herein.

Figure 6:
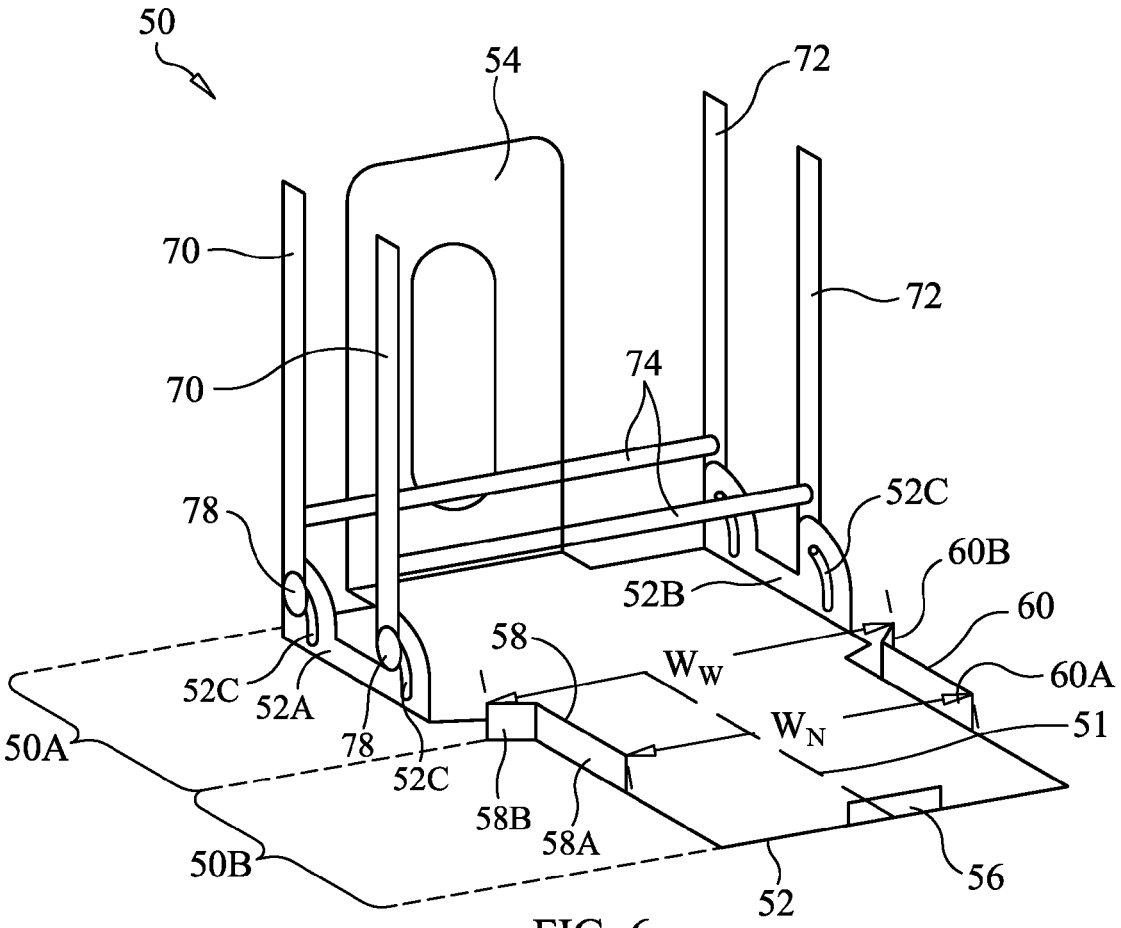
FIG. 6 is a perspective view of a box configuring tool in accordance with another embodiment of the present invention.

Another embodiment of a box configuring tool and dispenser in accordance with the present invention is illustrated in FIG. 6 and is referenced generally by numeral 50. Similar to the previously-described tool/dispenser 30, tool/dispenser 50 defines a staging region 50A and a chute region 50B, and includes features similar to those shown/described for tool/dispenser 30. More specifically, tool/dispenser 50 includes a base 52, a back stop 54, a front stop 56, chute walls 58 and 60, and a book-folded-blank dispenser at/above staging region 50A that is defined by side supports 70 and 72, back stop 54, and bottom rails 74 coupled to and spanning between side supports 70/72. In terms of function and use, tool/dispenser 50 is essentially identical to tool/dispenser 30. However, tool/dispenser 50 uses a single sheet of material (e.g., sheet of stainless steel) fabricated to monolithically define base 52, back stop 54, front stop 56, and chute walls 58 and 60. For example, these elements of tool/dispenser 50 could be stamped from a single sheet of metal that is then bent to define the elements.

Base 52 can include side brackets 52A and 52B that serve as mounting brackets for side supports 70/72. Brackets 52A/52B can include slots 52C such that supports 70/72 can be rotated from their vertical box-supporting orientation (as shown) to a flat orientation adjacent to base 52. Side supports 70/72 can be locked into position against brackets 52A/52B using, for example, locking screws 78.

Chute walls 58 and 60 are mirror images of one another relative to a center 51 of chute region 50B. Attributes of chute walls 58 and 60 are analogous to previously-described chute walls 18 and 20, respectively. That is, chute walls 58 and 60 include parallel linear portions 58A/60A and linear flared portions 58B/60B. Accordingly, chute walls 58/60 along with the portion of base 52 between walls 58/60 define an open-ended chute aligned with and spaced-apart from back stop 54 and front stop 56. The widest width $W_W$ between flared portions 58B/60B defines the widest width of the open-ended chute, and the narrowest width $W_N$ of the open-ended chute is defined by the spacing between parallel linear portions 58A/60A.

Figure 7:
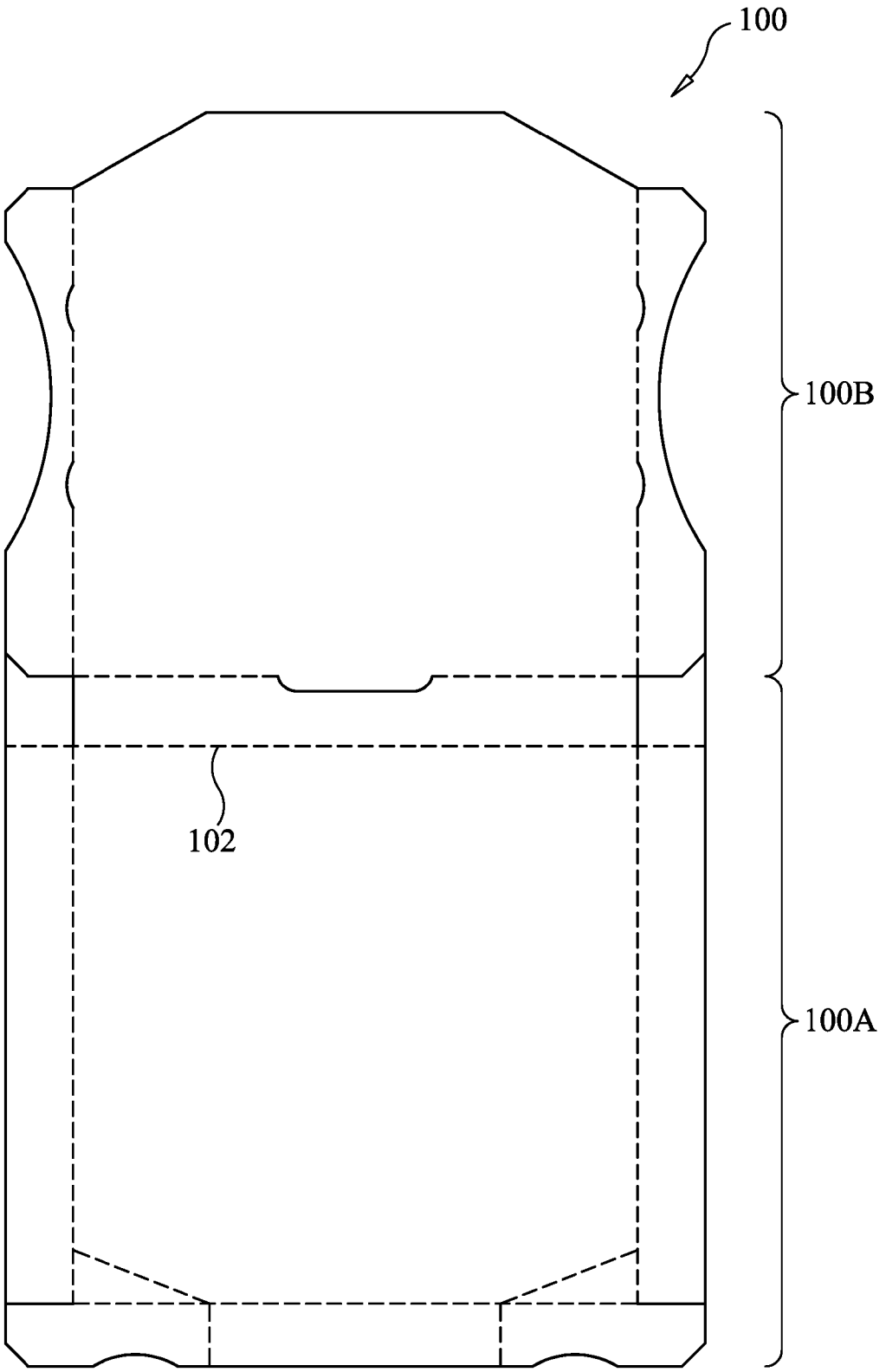
FIG. 7 (PRIOR ART)
FIG. 7 is a top plan view of a prior art, unassembled pizza box blank of sheet material.

The present invention can be used with a variety of styles of existing pizza box blanks. By way of example, one such pizza box blank will be described. Referring now to FIG. 7, an unfolded and unassembled prior art pizza box blank made of sheet material (e.g., cardboard) is shown and is referenced generally by numeral 100. Pizza box blank 100 is described in detail in U.S. Pat. No. 8,627,998. In general, dashed lines indicate areas of weakness such that folding along the dashed-line regions is facilitated. Solid lines within the periphery of blank 100 indicate cut lines. Region 100A will form the bottom of a box and region 100B will form the top of a box. In order for blank 100 to be used with the above-described embodiments of the present invention's configuring tool, blank 100 must be book folded along weakened/fold line 102 that spans the width of blank 100 to include the side regions thereof that will fold up to form the sides of a box's bottom region 100A. With blank 100 book-folded along line 102, it can be placed on/in the staging region of the present invention's configuration tool (or tool/dispenser) with fold line 102 against the above-described back stop or back support. As the book-folded blank 100 is pulled into/through the above-described open-ended chute from a position near the tool's front stop, the sides of bottom region 100A are folded up by the chute walls while the front of bottom region 100A is readily folded up at the tool's front stop. When this occurs, top region 100B is naturally hinged open along fold line 102 such that top region 100B forms an angle with bottom region 100A of approximately 45 degrees angle, i.e., the open-box configuration that can readily have a pizza placed onto bottom region 100A. The box can then be closed.

Figure 8:
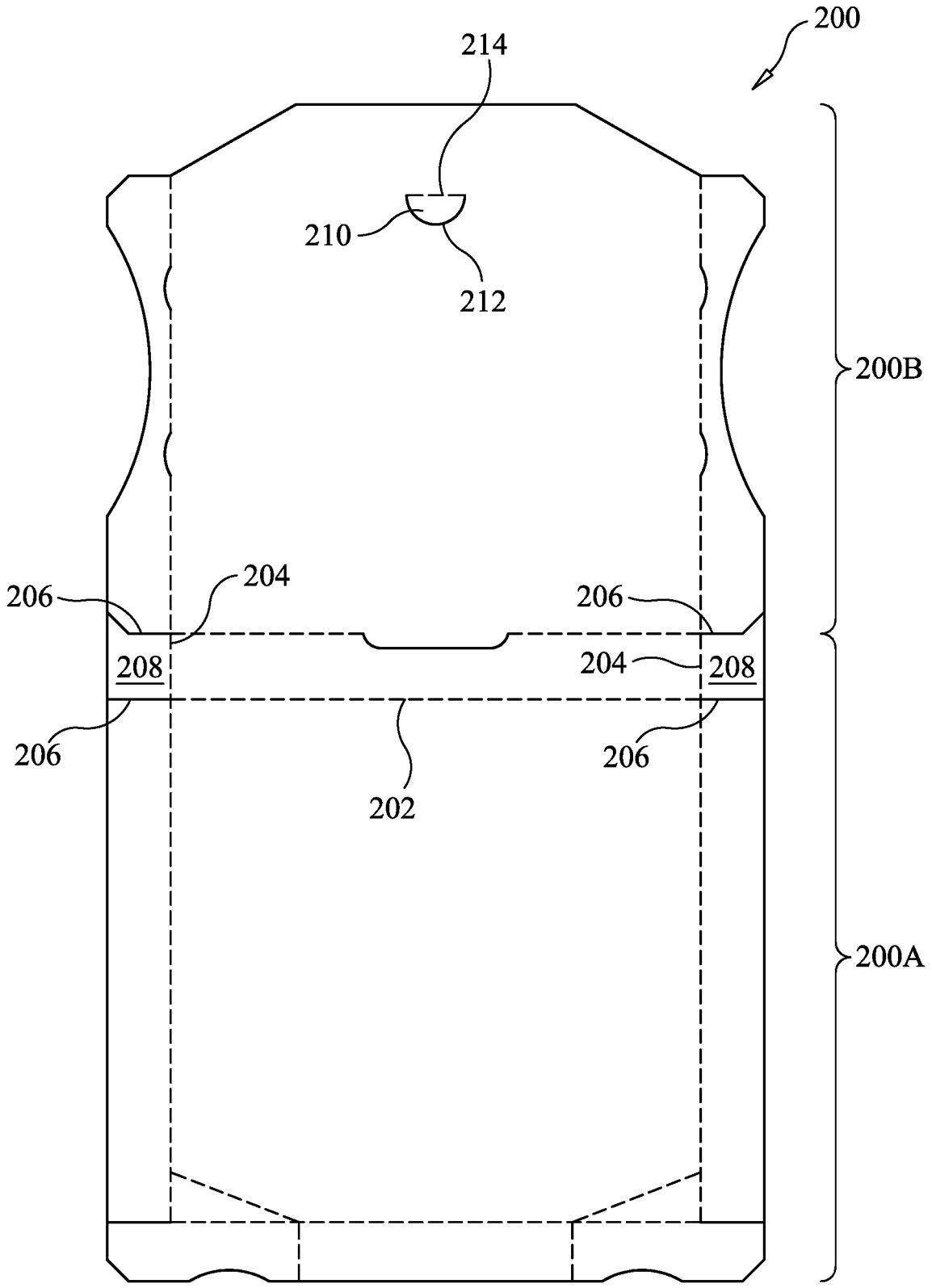
FIG. 8 is a top plan view of an unassembled pizza box blank of sheet material for use with a box configuring tool in accordance with the present invention.

While the configuring tool of the present invention can be used with a wide variety of existing box blank designs, a novel box blank design can also be used that is designed for efficient use with the configuring tool. By way of example, FIG. 8 illustrates the box blank shown in FIG. 7 with new features that improve its functionality when used with the configuring tool of the present invention. However, it is to be understood that these new features could also be incorporated into other box blank designs. In FIG. 8, box blank 200 has a bottom region 200A that will form the box bottom and a top region 200B that will form the box top. A fold line 202 spanning blank 200 will be used as the book-fold line. That is, blank 200 is folded along line 202 prior to placement on/in the configuring tool of the present invention. One of the new features of blank 200 includes fold lines 204 and cuts 206 at opposing sides such that back tabs 208 are formed during the configuring operation. Note that back tabs 208 could also be eliminated from blank 200 without departing from the scope of the present invention. Blank 200 can also include a finger-pull punch out 210 defined, for example, by a semi-circular cut line 212 and a fold line 214 in top region 200B. In this way, when blank 200 is book-folded along fold line 202, punch out 210 is readily accessible at the exposed surface of top region 200B. In this way, punch out 210 can be "hooked" by one's finger and used to pull blank 200 into/through the chute region of a configuring tool of the present invention.

The advantages of the present invention are numerous. The configuring tool quickly configures a pizza box into an open-box configuration thereof. One or more of the tools can be placed right at a pizza chef's station. The tool eliminates the need to pre-make and store boxes before they are needed thereby saving labor cost and space.

Although the invention has been described relative to specific embodiments thereof, there are numerous variations and modifications that will be readily apparent to those skilled in the art in light of the above teachings. For example, the chute can be customized to accommodate a wide variety of box designs, shapes, and sizes. It is therefore to be understood that, within the scope of the appended claims, the invention may be practiced other than as specifically described.

What is claimed as new and desired to be secured by Letters Patent of the United States is:

1. A box configuring tool, comprising:

a base having a planar surface;

a first stop positioned at a first end of said base and extending from said planar surface;

a second stop positioned at a second end of said base opposing said first end of said base, said second stop extending away from said planar surface; and an open-ended chute including a portion of said planar surface and a pair of spaced-apart contiguous-surface walls coupled to said base, said contiguous-surface walls extending along and away from said planar surface and located between said first stop and said second stop, said open-ended chute having a tapered-width portion contiguous with a constant-width portion, wherein said tapered-width portion and said constant-width portion extend successively along said planar surface and wherein said tapered-width portion terminates at a first open end of said open-ended chute and said constant-width portion terminates at a second open end of said open-ended chute.

2. A box configuring tool as in claim 1, further comprising a box dispenser coupled to said base and extending away from said planar surface, said box dispenser including a support platform spaced-apart from said planar surface and between said tapered-width portion of said open-ended chute and one of said first stop and said second stop.

3. A box configuring tool as in claim 1, wherein said base, said first stop, said second stop, and said walls comprise a monolithic structure.

4. A box configuring tool as in claim 1, wherein said base, said first stop, said second stop, and said walls comprise stainless steel.

5. A box configuring tool as in claim 1, wherein said tapered-width portion has a widest width at said first open end of said open-ended chute, said constant-width portion has a constant width less than said widest width, and said constant-width portion extends to said second open end of said open-ended chute, said first open end and said second open end being aligned with said first stop and said second stop wherein said open-ended chute lies along a path on said planar surface between said first stop and said second stop.

6. A box configuring tool as in claim 1, wherein each of said walls is non-linear along said tapered-width portion of said open-ended chute.

7. A box configuring tool as in claim 1, wherein each of said walls is linear along said tapered-width portion of said open-ended chute.

8. A box configuring tool for a folded-box blank, comprising:

a base having a planar surface;

a first stop positioned at a first end of said base and extending from said planar surface;

a second stop positioned at a second end of said base opposing said first end of said base, said second stop extending away from said planar surface;

an open-ended chute including a portion of said planar surface and a pair of spaced-apart contiguous-surface walls coupled to said base and extending vertically away from said planar surface, said open-ended chute spaced apart from said first stop wherein a folded-box blank staging region on said planar surface lies between said open-ended chute and said first stop, and wherein a path along said planar surface between said first stop and said second stop includes said open-ended chute;

said open-ended chute having a tapered-width portion contiguous with a constant-width portion wherein said tapered-width portion and said constant-width portion extend successively along said planar surface;

said tapered-width portion having a widest width at a first open end of said open-ended chute;

said constant-width portion having a constant width less than said widest width;

said constant-width portion extending to a second open end of said open-ended chute; and wherein, when a folded-box blank adapted to be positioned on said folded-box blank staging region is pulled from said folded-box blank staging region and along said path and through said open-ended chute, the folded-box blank is converted to an open box.

9. A box configuring tool as in claim 8, further comprising a folded-box blank dispenser coupled to said base and extending away from said planar surface, said folded-box blank dispenser including a support platform above said folded-box blank staging region.

10. A box configuring tool as in claim 8, wherein said base, said first stop, said second stop, and said walls comprise a monolithic structure.

11. A box configuring tool as in claim 8, wherein said base, said first stop, said second stop, and said walls comprise stainless steel.

12. A box configuring tool as in claim 8, wherein each of said walls is non-linear along said tapered-width portion of said open-ended chute.

13. A box configuring tool as in claim 8, wherein each of said walls is linear along said tapered-width portion of said open-ended chute.

* * * * *